US005866879A

United States Patent [19]

Higgins

[11] Patent Number: 5,866,879

[45] Date of Patent: Feb. 2, 1999

[54] INFRA-RED HEATER ARRANGEMENT

[75] Inventor: George Anthony Higgins, Stourbridge, United Kingdom

[73] Assignee: Ceramaspeed Limited, United Kingdom

[21] Appl. No.: 743,713

[22] Filed: Nov. 6, 1996

[30] Foreign Application Priority Data

Nov. 15, 1995 [GB] United Kingdom ..... 9523348

[51] Int. Cl.[6] ..... H05B 3/68

[52] U.S. Cl. ..... 219/466; 219/464

[58] Field of Search ..... 219/441, 519, 219/553, 465, 549, 466, 464, 485, 270, 506, 501, 486

[56] References Cited

U.S. PATENT DOCUMENTS 4,808,798 2/1989 Goessler et al. .

FOREIGN PATENT DOCUMENTS

| | | |
|---|---|---|
| 0176027 | 4/1986 | European Pat. Off. . |
| 0235895 | 9/1987 | European Pat. Off. . |
| 0331369 | 9/1989 | European Pat. Off. . |
| 0429244 | 5/1991 | European Pat. Off. . |
| 0551172 | 1/1993 | European Pat. Off. . |
| 675539 | 3/1950 | United Kingdom . |
| 2175464 | 5/1986 | United Kingdom . |

OTHER PUBLICATIONS

European; Search Report No. EP 96 30 7577.

*Primary Examiner*—Teresa J. Walberg
*Assistant Examiner*—Vinod D. Patel
*Attorney, Agent, or Firm*—Ira S. Dorman

[57] ABSTRACT

An infra-red heater arrangement for a glass-ceramic top cooking appliance includes a heater connected to a manually adjustable cyclic energy regulator having a full power setting and a plurality of other, lower power, settings. The heater incorporates at least one infra-red heating element having a substantial positive temperature coefficient of electrical resistance and first and second electrical resistance heating elements having low temperature coefficients of electrical resistance relative to that of the at least one infra-red heating element. The first electrical resistance heating element can be connected in series with the at least one infra-red heating element and to a power supply in the full power setting of the cyclic energy regulator, which setting is attainable directly from an 'OFF' setting of the regulator. The infra-red heating element and the first and second electrical resistance heating elements are provided in an undivided heating zone and the first and second electrical resistance heating elements can be connected in series and in series with the at least one infra-red heating element, and to the power supply, for cyclic energisation, at duty cycles including 100 percent, in the other settings of the cyclic energy regulator.

9 Claims, 2 Drawing Sheets

INFRA-RED HEATER ARRANGEMENT

This invention relates to an infra-red heater, for use in a glass ceramic top cooking appliance and arranged for operation with a cyclic energy regulator, the heater incorporating at least one infra-red heating element having a substantial positive temperature coefficient of electrical resistance, particularly at least one infra-red lamp.

BACKGROUND TO THE INVENTION

In a heater of this kind, it is known to provide a resistance heating element of coil or ribbon form having a temperature coefficient of resistance which is low relative to that of the at least one infra-red lamp and connect this in series with the infra-red lamp or lamps at least in some conditions of operation of the heater. Such a resistance element contributes to the output power of the heater, particularly enabling low output power to be obtained from the heater at low energy settings of the cyclic energy regulator and also acting as ballast for the infra-red lamp or lamps to prevent excessively high current flow on energising the heater.

DESCRIPTION OF PRIOR ART

EP-A-0 206 597 describes such a heater in association with a cyclic energy regulator. A manually rotatable control knob is used to adjust the cyclic energy regulator so that the heater is operated at selected duty cycles according to the rotational position of the knob.

In one embodiment, in all settings of the control knob except the full power setting, an infra-red lamp element is energised in series with a coiled wire resistance element, referred to as a ballast resistor. In the full power setting, the infra-red lamp element is energised directly and not by way of the coiled wire resistance element. This is advantageous since it provides a power boost for optimum performance and results in minimum boiling times for the contents of a cooking utensil.

A significant disadvantage of this arrangement is that this full power setting can only be achieved by first passing through the lower power settings. This means that an aesthetically desirable fast light-up of the infra-red lamp element to full brightness, such as by switching directly to the full power setting from 'OFF', cannot be achieved.

In another embodiment, in all power settings of the control knob (including the full power setting), an infra-red lamp element is energised in series with a coiled wire ballast resistance element. This is advantageous in that it does not require the control knob to be first passed through the lower power settings in order to achieve the full power setting. The infra-red lamp and the coiled wire ballast resistance element may be positioned in a central, circular, heating zone with a further coiled wire resistance element positioned in a separate annular heating zone separated from the central heating zone by a dividing wall. The further coiled wire resistance element may be connected in parallel with the series-connected infra-red lamp and coiled wire ballast resistance element to adapt the heated area to larger cooking utensils.

However, a significant disadvantage of this arrangement is that the range of power outputs of the heater is restricted, especially in the low power settings of the control knob.

OBJECT OF THE INVENTION

It is therefore an object of the present invention to overcome these disadvantages of the prior art.

SUMMARY OF THE INVENTION

According to the present invention there is provided an infra-red heater arrangement for a glass-ceramic top cooking appliance, comprising a heater connected to a manually adjustable cyclic energy regulator having a full power setting and a plurality of other, lower power, settings, the heater incorporating at least one infra-red heating element having a substantial positive temperature coefficient of electrical resistance and first and second electrical resistance heating elements having low temperature coefficients of electrical resistance relative to that of the at least one infra-red heating element and means for connecting the first electrical resistance heating element in series with the at least one infra-red heating element and to a power supply in the full power setting of the cyclic energy regulator, which setting is attainable directly from an 'OFF' setting of the regulator, wherein the infra-red heating element and the first and second electrical resistance heating elements are provided in an undivided heating zone and means is provided for connecting the first and second electrical resistance heating elements in series and in series with the at least one infra-red heating element, and to the power supply, for cyclic energisation, at duty cycles including 100 percent, in the other settings of the cyclic energy regulator.

By means of the invention, a control knob on the cyclic energy regulator may be turned from an 'OFF' setting immediately to the full power setting, in which there is no cycling of the supplied power, to achieve fast light-up to full brightness of the at least one infra-red heating element. This is aesthetically appealing to the user as well as providing an almost instantaneous power boost. The control knob may also be turned from the 'OFF' setting to the full power setting through intermediate power settings in which the heater is operated at selected duty cycles including 100 percent to give a range of lower heater powers, the first and second resistance heating elements being connected in series and in series with the at least one infra-red heating element in these intermediate power settings. As the control knob is turned to the full power setting from the lower settings a stepwise increase in brightness of the at least one infrared heating element occurs as the second resistance heating element is deactivated, leaving only the first resistance heating element actively connected in series with the at least one infra-red heating element.

The provision of the two series-connected first and second resistance heating elements in series with the at least one infra-red heating element is particularly advantageous in that in the lowest settings of the energy regulator it results in very low power outputs from the heater which is desirable for low simmering of contents in a cooking utensil. In the full power position, with only the first resistance heating element connected in series with the at least one infra-red heating element, it provides a higher power output than would otherwise be available.

The at least one infra-red heating element may comprise at least one infra-red lamp, such as comprising a tungsten filament in a sealed enclosure containing a halogenated atmosphere.

The first and second resistance heating elements may be of coiled wire or of ribbon form comprising an electrical resistance alloy such as iron-chromium-aluminium. The first and second resistance heating elements may comprise two separate elements or a single element with a tapping connection provided intermediate ends thereof.

When the first and second resistance heating elements are connected in series with one another and with the at least one infra-red heating element, connection of the first electrical resistance heating element in series with the at least one infra-red heating element in the full power setting may be effected by short-circuiting the second resistance heating element. Such short-circuiting is suitably achieved by means of switch contacts in or associated with the cyclic energy regulator.

For a better understanding of the present invention and to show more clearly how it may be carried into effect reference will now be made, by way of example, to the accompanying drawings in which:

DESCRIPTION OF PREFERRED EMBODIMENT

An infra-red heater 1 comprises a base layer 2 of thermal insulation material, such as microporous thermal insulation material, a peripheral wall 3 of thermal insulation material and a metal dish 4 supporting the base layer 2 and the peripheral wall 3. The heater is arranged such that, when installed in a glass-ceramic top cooking appliance, the top surface of the peripheral wall 3 contacts the underside of the glass-ceramic cook top (not shown).

Figure 1:
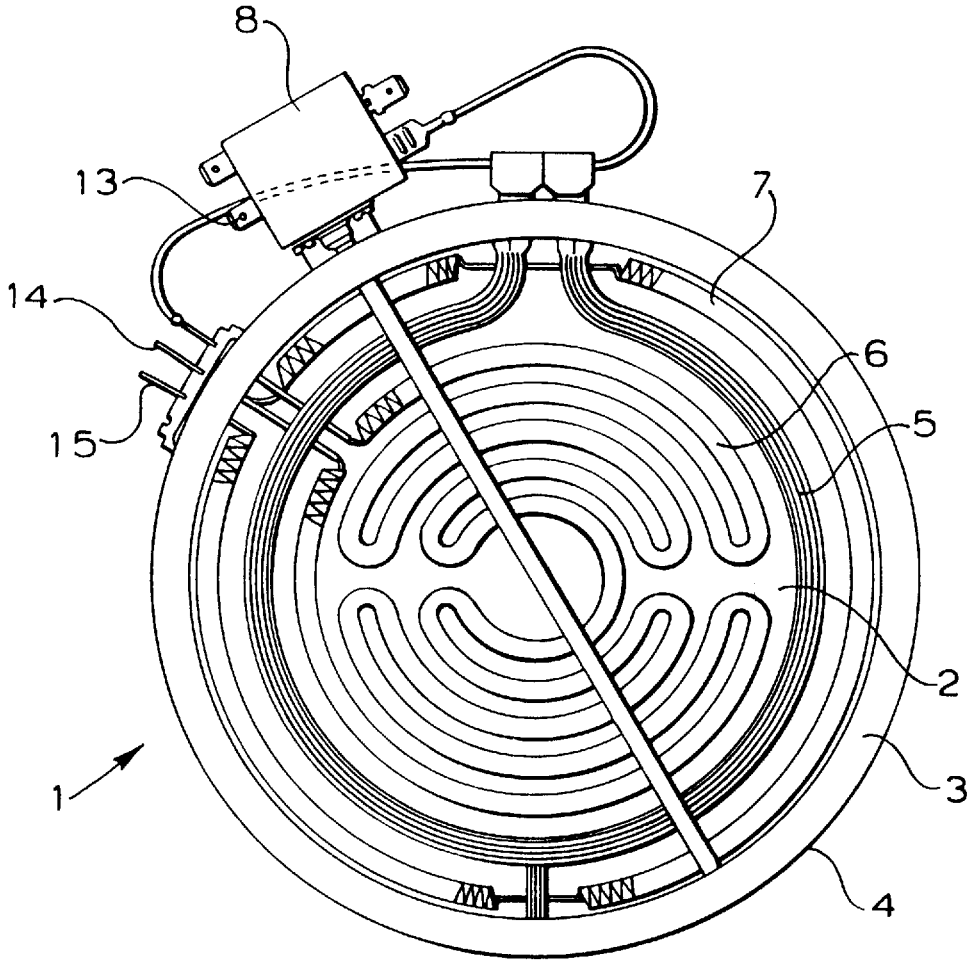
FIG. 1 is a plan view of an embodiment of an infra-red heater for use in the arrangement of the present invention.

A circular infra-red lamp 5, having a substantial positive temperature coefficient of resistance and comprising a tungsten filament (shown diagrammatically in FIG. 1) inside a sealed enclosure of quartz or fused silica containing a halogenated atmosphere, is arranged on or above the base layer 2.

First and second electrical resistance elements 6 and 7 are of coiled bare resistance wire or corrugated ribbon supported edgewise on the base layer 2 and are made from a material which has a low temperature coefficient of resistance relative to that of the infra-red lamp 5. The first and second electrical resistance elements may be made, for example, of an iron-chromium-aluminium alloy. The first and second electrical resistance elements 6 and 7 are arranged on the base layer 2, element 7 being in the peripheral region of the heater and element 6 being in the central region of the heater.

Thus the infra-red lamp 5 and the first and second electrical resistance elements 6 and 7 are provided in an undivided heating zone.

A thermal cut-out device 8 extends across the heater and serves to electrically disconnect the heater from a power supply if, in use, the temperature of the glass-ceramic cook top (not shown) becomes excessive.

Figure 2:
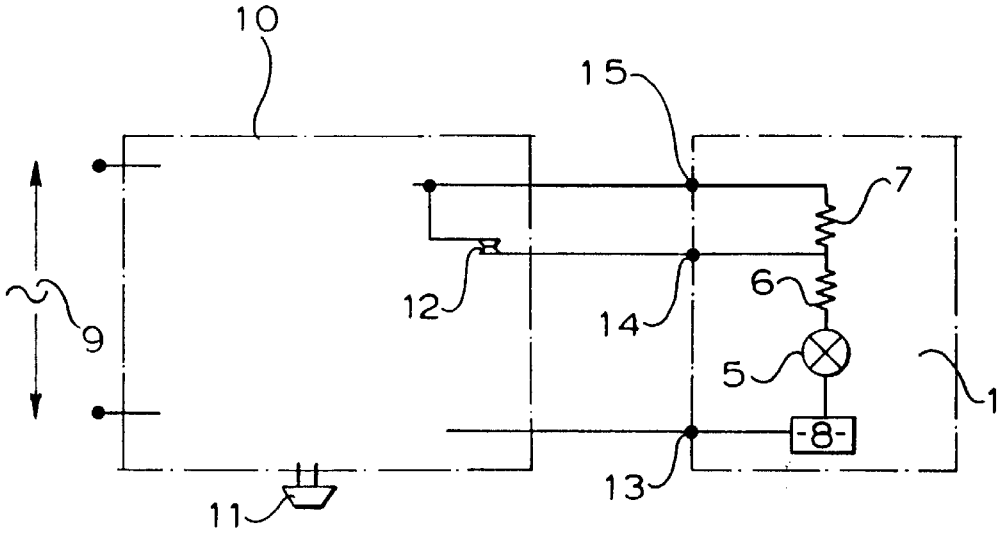
FIG. 2 is a diagrammatic representation of an embodiment of an infra-red heater arrangement according to the present invention incorporating the heater of FIG. 1 together with a cyclic energy regulator.

The infra-red lamp 5 and first and second resistance heating elements 6 and 7 are arranged for electrical connection to one another and to a power supply 9, for example of 230 volts, by way of a known form of cyclic energy regulator 10, as shown in FIG. 2. The connections to the heater from the regulator are denoted by reference numerals 13, 14, 15. The cyclic energy regulator is manually adjustable by means of a rotatable control knob 11 to provide a range of power settings for the heater 1, and can be arranged to be adjustable in either continuously variable or stepwise manner by design.

The cyclic energy regulator is able to be adjusted to a full power setting in two ways. If the control knob 11 is rotated from an 'OFF' position in one direction of rotation, the full power setting is obtained immediately, directly adjacent the 'OFF' position. If the control knob 11 is rotated from the 'OFF' position in the opposite direction of rotation, then the full power setting is only obtained after passing through all lower power settings of the regulator 10. The arrangement of the invention is such that in the full power setting, regardless of how this setting is reached, the supply voltage 9 is applied, without cycling, to a series combination of the infra-red lamp 5 and the first resistance heating element 6. By way of example, this combination may be arranged such that with a 230 volts supply, the infra-red lamp 5 develops 1320 watts and the series element 6 develops 1080 watts, making a total heater power in the full power setting of 2400 watts. This full power setting, with 55 percent of the total power developed in the lamp 5 and 45 percent of the total power developed in the element 6 serves as a boost setting and is particularly advantageous in that it can be reached immediately from the 'OFF' position of the regulator 10 without having to turn the control knob 11 through the lower power settings as was the case with the prior art arrangement. The resultant, almost instantaneous, fast light-up of the infra-red lamp in switching directly to the full power setting immediately from the 'OFF' position is very appealing to the user.

In all other settings of the energy regulator 10, the second resistance heating element 7 is connected in series with the first resistance heating element 6 and the series combination of heating elements 6 and 7 is connected in series with the infra-red lamp 5. The resulting series combination of lamp 5 and elements 6, 7 is energised by the cyclic energy regulator 10 from the power supply 9, at selected duty cycles including 100 percent, according to the setting of the control knob 11.

In the present specific example, element 7 may develop a power of 550 watts, while element 6 develops a power of 675 watts and the infra-red lamp develops 675 watts, during the period of energising from the 230 volts supply in each duty cycle selected by the control knob 11. It will be noted that the inclusion of element 7 in series with element 6 and lamp 5 increases the resistance in series with lamp 5 and reduces the filament temperature of the lamp. This, in turn, reduces the resistance of the lamp filament and changes the proportion of power developed by the lamp 5 relative to the element 6.

The maximum available heater power at other than full power setting is therefore 1900 watts, with about 28 percent of this power being developed in the element 7, about 36 percent in the element 6 and about 36 percent in the lamp 5. Thus the actual heater power in the lower power settings of the energy regulator, other than the full power setting, is 1900 watts, or a proportion thereof, varied according to the rotational position of the control knob 11.

Figure 3:
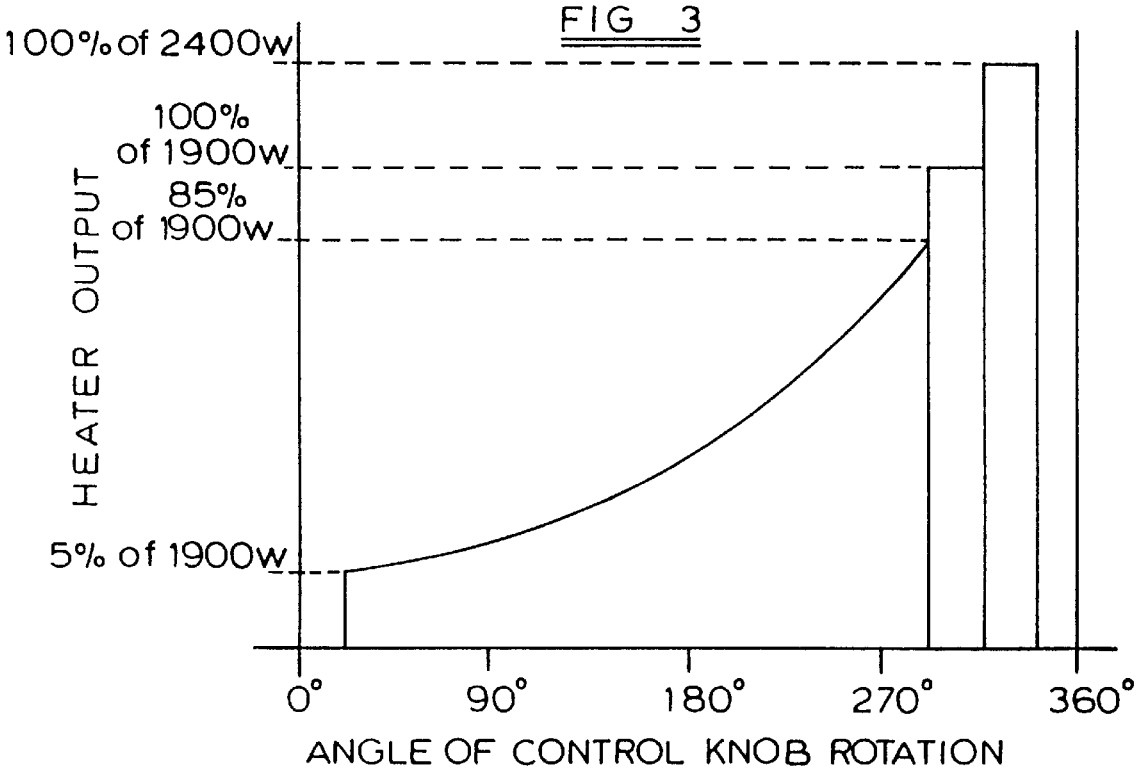
FIG. 3 is a graph showing the energy output of the heater arrangement of FIG. 2 as a function of angular position of a control knob of the cyclic energy regulator.

FIG. 3 shows the energy output of this specific example of the heater 1 as a function of the angle of rotation of the control knob 11. As already stated, the full power setting, identified as '100% of 2400 watts' can be reached either by passing through the lower power settings, at which a range of heater energy outputs from as low as a very useful '5% of 1900 watts' (for low power simmering purposes) up to 1900 watts can be obtained, or by turning the control knob in the opposite direction immediately to the full power setting. Regardless of which way the full power setting is reached, it is arranged that at this setting a set of contacts 12, actuated by the control knob 11 in the regulator 10, closes and short circuits the second heating element 7 so that the series combination of lamp 5 and first heating element 6 is only connected to the power supply.

In whichever direction the control knob 11 is turned from the full power setting, the contacts 12 are caused to be opened and the second heating element 7 is brought into circuit. This arrangement is very convenient since it allows a series chain comprising the lamp 5 and elements 6 and 7 to be provided, with the element 7 being conveniently and automatically short circuited in the full power setting.

The first and second heating elements 6 and 7 could be provided as separate elements or as a single element with an intermediate tapping connection.

I claim:

1. An infra-red heater arrangement for a glass-ceramic top cooking appliance, comprising a heater connected to a manually adjustable cyclic energy regulator having a full power setting and a plurality of other, lower power, settings, the heater incorporating at least one infra-red heating element having a substantial positive temperature coefficient of electrical resistance and first and second electrical resistance heating elements having low temperature coefficients of electrical resistance relative to that of the at least one infra-red heating element and means for connecting the first electrical resistance heating element in series with the at least one infra-red heating element and to a power supply in the full power setting of the cyclic energy regulator, which setting is attainable directly from an 'OFF' setting of the regulator, wherein the infra-red heating element and the first and second electrical resistance heating elements are provided in an undivided heating zone and means is provided for connecting the first and second electrical resistance heating elements in series and in series with the at least one infra-red heating element, and to the power supply, for cyclic energisation, at duty cycles including 100 percent, in the other settings of the cyclic energy regulator.

2. A heater arrangement as claimed in claim 1, wherein the at least one infra-red heating element comprises at least one infra-red lamp.

3. A heater arrangement as claimed in claim 2, wherein the at least one infra-red lamp comprises a tungsten filament in a sealed enclosure containing a halogenated atmosphere.

4. A heater arrangement as claimed in claim 1, wherein the first and second resistance heating elements are selected from the group consisting of coiled wire and ribbon form.

5. A heater arrangement as claimed in claim 4, wherein the first and second resistance elements comprise iron-chromium-aluminium alloy.

6. A heater arrangement as claimed in claim 4, wherein the first and second resistance elements are selected from the group consisting of two elements and a single element with a tapping intermediate ends thereof.

7. A heater arrangement as claimed in claim 1, wherein the first and second resistance heating elements are connected in series with one another and with the at least one infra-red heating element and wherein connection of the first electrical resistance heating element in series with the at least one infra-red heating element in the full power setting is effected by short-circuiting the second resistance heating element.

8. A heater arrangement as claimed in claim 7, wherein short-circuiting of the second resistance heating element is achieved by means of switch contacts in the cyclic energy regulator.

9. A heater arrangement as claimed in claim 7, wherein short-circuiting of the second resistance heating element is achieved by means of switch contacts associated with the cyclic energy regulator.

* * * * *